US006641347B2

(12) United States Patent
Ewington

(10) Patent No.: US 6,641,347 B2
(45) Date of Patent: Nov. 4, 2003

(54) POLE EXTRACTOR

(75) Inventor: James Ewington, Mississauga (CA)

(73) Assignee: 1479502 Ontario Inc., Mississauga (CA)

( * ) Notice: Subject to any disclaimer, the term of this patent is extended or adjusted under 35 U.S.C. 154(b) by 0 days.

(21) Appl. No.: 09/879,929

(22) Filed: Jun. 14, 2001

(65) Prior Publication Data

US 2002/0192053 A1 Dec. 19, 2002

(51) Int. Cl.[7] ..... B66F 11/00

(52) U.S. Cl. ..... 414/23; 414/724; 414/745.2; 414/911; 254/29 R

(58) Field of Search ..... 414/724, 23, 745.2, 414/911; 254/228, 31, 29 R

(56) References Cited

U.S. PATENT DOCUMENTS

| | | | | |
|---|---|---|---|---|
| 953,234 | A | | 3/1910 | Rountree |
| 975,832 | A | | 11/1910 | Clore |
| 2,484,400 | A | | 10/1949 | Brown |
| 2,654,630 | A | | 10/1953 | Renfroe |
| 3,163,398 | A | * | 12/1964 | Eckels ..... 254/29 R |
| 3,173,658 | A | | 3/1965 | Verrell et al. |
| 3,233,868 | A | | 2/1966 | Harvey et al. |
| 3,239,263 | A | | 3/1966 | Farmer et al. |
| 3,647,185 | A | | 3/1972 | Phibbs |
| 3,908,844 | A | * | 9/1975 | Duffield ..... 414/724 |
| 4,082,192 | A | | 4/1978 | Cox |
| 4,256,286 | A | * | 3/1981 | Hudgins ..... 254/30 |
| 4,327,534 | A | | 5/1982 | Mastalski et al. |
| 4,822,006 | A | * | 4/1989 | McIntire ..... 254/228 |
| 6,056,271 | A | * | 5/2000 | Riojas ..... 254/29 R |
| 6,129,226 | A | | 10/2000 | Donovan |
| 6,302,380 | B1 | * | 10/2001 | Ultimo et al. ..... 254/228 |
| 6,382,594 | B1 | * | 5/2002 | Ransom ..... 254/30 |

* cited by examiner

*Primary Examiner*—Eileen D. Lillis
*Assistant Examiner*—Michael Lowe
(74) *Attorney, Agent, or Firm*—Ingrid E. Schmidt

(57) ABSTRACT

A pole extractor having a base and a hydraulically operable cylinder and ram assembly. The base is coupled to an attachment means to define a slot for accepting a mobile positioning device. The cylinder and ram assembly have a proximal end coupling said assembly to the base. The ram has a distal end remote from the base, which has a connecting means to accept a holding means. In use, the holding means releasably holds a pole. The cylinder and ram assembly has a fluid inlet and a fluid outlet to communicate with an actuating means that controls extension of the ram within the cylinder, which in turn extracts the pole. In use, a pole is choked to the ram and the ram is actuated in order to extract the pole from a substrate.

11 Claims, 8 Drawing Sheets

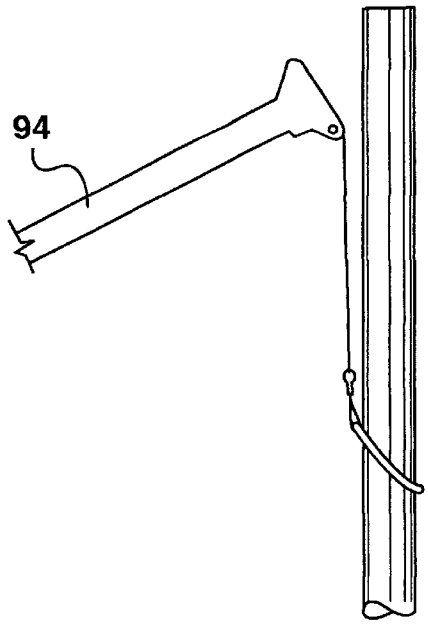
FIG. 10
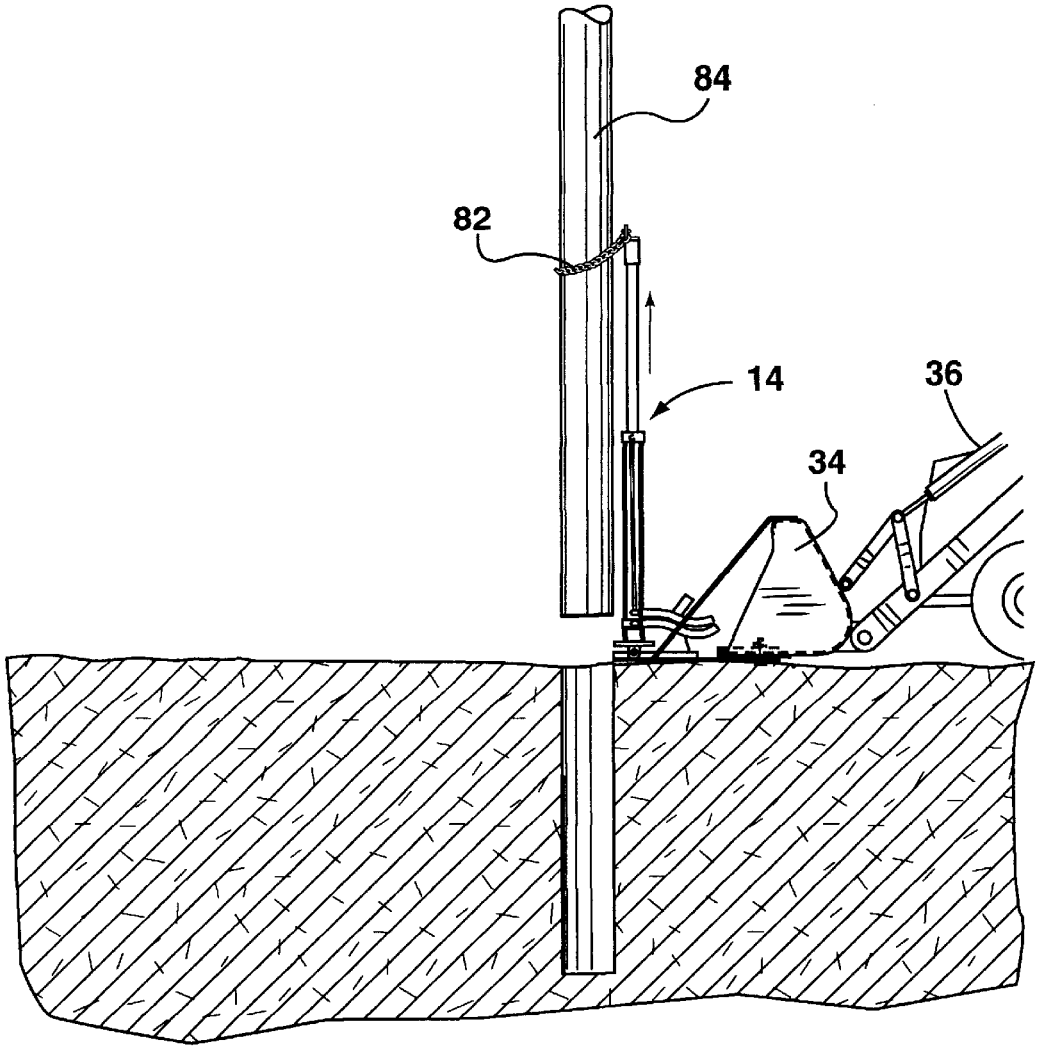

POLE EXTRACTOR

FIELD OF THE INVENTION

The invention relates to a means for removing poles, specifically, an extractor that utilizes a cylinder and ram assembly that attaches to a pole and extracts it from the substrate, without damaging the surroundings.

BACKGROUND OF THE INVENTION

Current methods to remove utility poles, posts or the like (herein referred to collectively as poles) from the ground rely upon a mobile derrick. In order to remove a pole, the derrick is connected to a pole at or near the top of the pole. The pole is then loosened by moving the boom of the derrick forwards, backwards and sideways. If the pole can be loosened in this manner, the derrick is then used to lift the pole from the hole. This approach to removing poles unduly stresses the boom, the turning means and the hydraulic system of the derrick, resulting in costly repairs, re-certification of the equipment and loss of machine hours.

Frequently, the pole cannot be loosened with the derrick. Alternative methods for loosening are then employed. One approach is to simply employ workers to dig a hole around the pole. Another method involves the use of vacuum. A large capacity vacuum, such as that used to clean out storm sewer manholes, removes substrate from around the pole. The pole is then lifted with the aid of the derrick. The disadvantages of these approaches include manpower costs, disturbance of the surrounding substrate and, in the case of the vacuum approach, additional equipment costs.

Approaches that have been developed to overcome the above-mentioned deficiencies include the use of a single hydraulic jack as taught in U.S. Pat. Nos. 3,173,658 and 3,163,398. The single hydraulic jack has the following disadvantages:

1. The jack has to be assembled to extract the pole and then disassembled in order to move it to another pole. This is time consuming and can be hazardous to the workers;
2. There is frequently insufficient power to extract the pole;
3. The base is too small and hence it frequently is driven into the ground rather than the pole being extracted;
4. The shape of the base restricts the size and shape of poles that can be removed.

The apparatus described in U.S. Pat. No. 4,822,006, while overcoming a number of deficiencies of the prior art, also has disadvantages. These impact on the speed, effectiveness, and utility of the invention as follows.

In U.S. Pat. No. 4,820,006 there are two hydraulic jacks that must work in concert. In order for the jacks to work in concert, the hydraulic lines must provide the same pressure. Unfortunately, hydraulic lines are notorious for bleeding. If this occurs on one line and not the other, operation of the two jacks will become uncoordinated.

Another disadvantage of the invention described in U.S. Pat. No. 4,822,006 is that the base is free standing. This means that the base could be driven into the ground when the pole is being extracted, thereby reducing the effectiveness of the apparatus. It also means that the apparatus must be loaded and unloaded from a suitable piece of heavy equipment prior to and after use. Again, this takes time and can be hazardous to the workers.

In U.S. Pat. No. 4,822,066 the applicant notes that rotation of the head is essential for the operation of the apparatus. This precludes the removal of concrete poles, as in order to lift these, a cable or chain must be threaded through an opening in the pole.

A final disadvantage of the prior art is that the U or V shape of the base places a restriction on the diameter and shape of the pole that can be extracted. The base must fit around the pole, such that one hydraulic jack is on one side of the pole and the other hydraulic jack is on the other side of the pole.

It is the objective of the present invention to overcome the deficiencies in the prior art.

SUMMARY OF THE INVENTION

According to the invention, a pole extractor is provided to rapidly and safely remove poles. The pole extractor has a base and a hydraulically operable cylinder and ram assembly. The base functions to support the cylinder and ram assembly and to displace the force exerted during extraction of a pole. In order to do so, the base is coupled to an attachment means to define a slot. This slot accepts and holds a mobile positioning device, which for example, may be a piece of heavy equipment or an attachment on the heavy equipment. A variety of heavy equipment attachments can be used, for example a bucket or blade, hereinafter referred to collectively as a bucket.

The cylinder and ram assembly is pivotally mounted on the base to facilitate working on uneven or inclined surfaces. During operation, a holding means, which is attached to a connecting means on a ram, releasably holds the pole. Extension and retraction of the ram is controlled by an actuating means which is preferentially remote from the pole extractor, but which is in fluid communication with the cylinder and ram assembly by means of a fluid inlet and a fluid outlet. The ram is actuated in order to extract the pole from a substrate.

From the above description it is clear that the invention provides a rapid, safe means for extracting poles from the ground or any other substrate.

DESCRIPTION OF THE DRAWINGS

Embodiments of the invention will now be described, by way of example, with reference to the following drawings in which:

FIG. 10 is a side elevation view of a pole extractor as shown in FIG. 1, showing the pole extracted from the substrate and being supported by a derrick.

DETAILED DESCRIPTION OF THE PREFERRED EMBODIMENT

Figure 1:
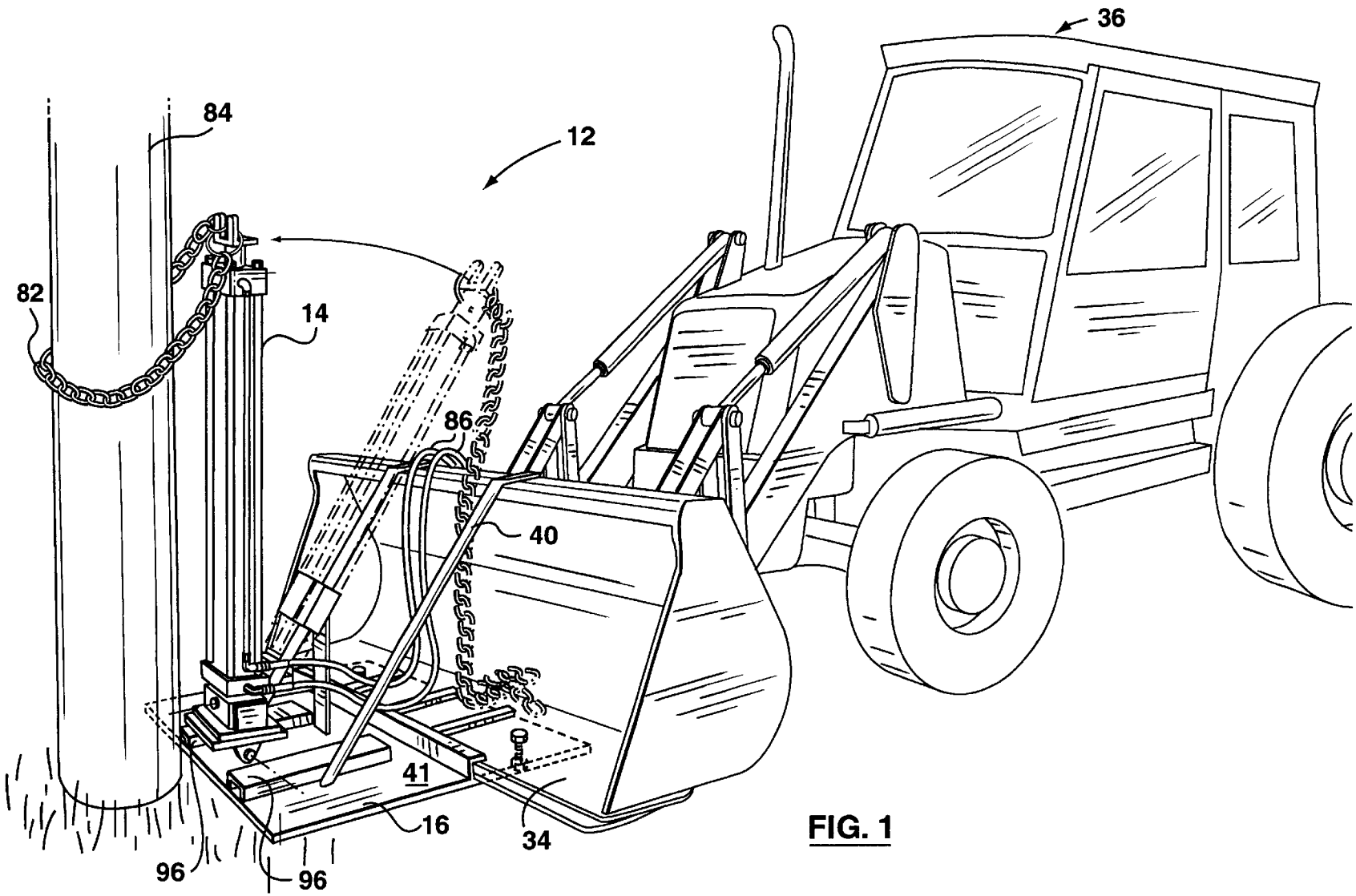
FIG. 1 is a perspective view of a pole extractor according to the invention showing a chain attached to a pole and the pole extractor mounted on a bucket of a piece of heavy equipment.
Figure 2:
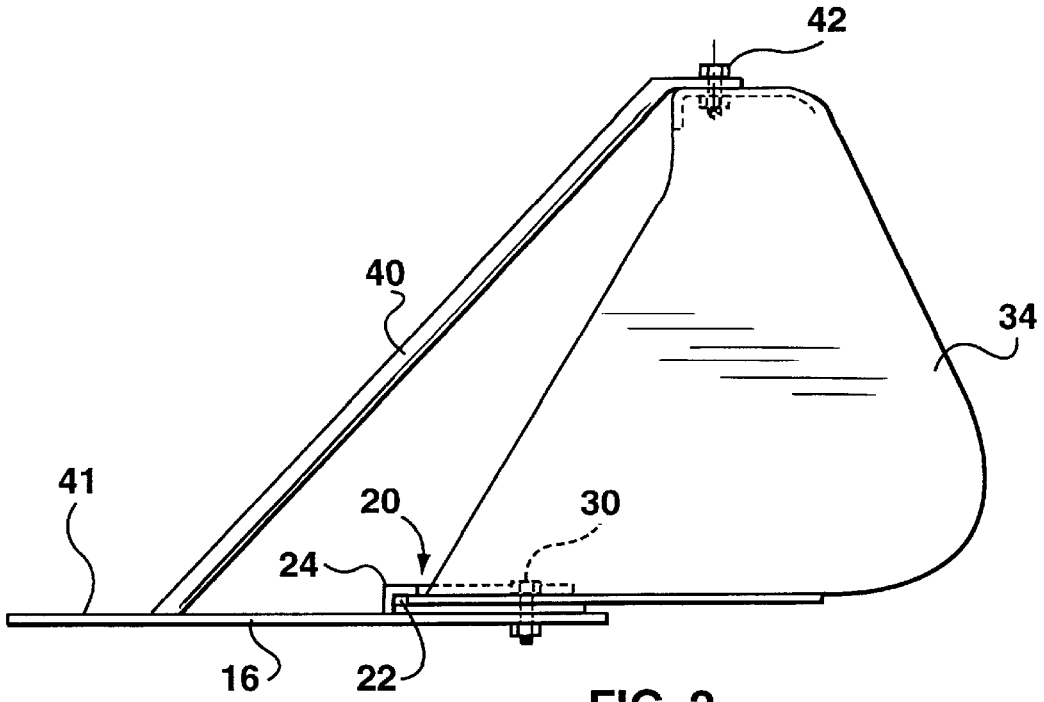
FIG. 2 is a side elevation view of a base and support member of the pole extractor on the bucket as shown in FIG. 1.

As shown in FIG. 1, the invention is a pole extractor (12), comprised of a hydraulically operable cylinder and ram assembly (14) and a base (16). FIG. 2 shows that the base (16) is coupled to an attachment means (20), the two together defining a slot (22).

The base (16) performs a number of functions; it is a mounting site for the cylinder and ram assembly (14); it provides a large surface area over which the downward force exerted by the cylinder and ram assembly (14) can be spread; it provides stabilization for the extractor (12); and it functions with the attachment means (20) to affix the extractor (12) to a mobile positioning device, such as a piece of heavy equipment (36), as described below.

Figure 3:
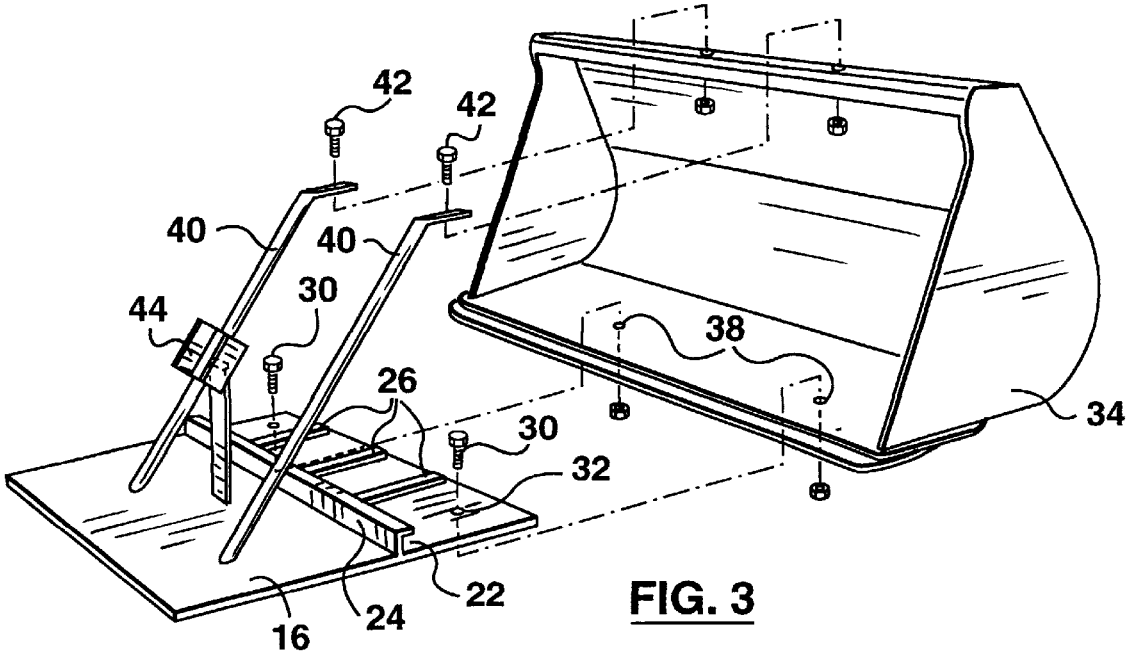
FIG. 3 is a perspective, exploded view of the base, support members, rest and attachment means of the pole extractor on the bucket as shown in FIG. 1.

As shown in FIGS. 2 and 3, the attachment means (20) has a lip (24), a plurality of extension bars (26) and a plurality of bolts (30). As shown in FIG. 3, three extension bars (26) are mounted on the lip (24) and are spaced along the length of the base (16). The extension bars (26) extend at least partially over the base (16). The base (16) has a plurality of base holes (32). In use, the lip (24) and extension bars (26) slide over a bucket (34) of the piece of heavy equipment (36) while the base (16) slides under the bucket (34). Each bolt (30) acts as a holding means and passes through the base hole (32) and a corresponding bucket hole (38) to engage the bucket (34) in the attachment means (20), thereby positioning the pole extractor (12) on the piece of heavy equipment (36).

This attachment of the extractor (12) to the bucket (34) is a significant improvement over the prior art. It stabilizes the extractor (12), in addition to spreading the downward force. Further to this, it provides a rapid means of moving and then positioning the extractor (12). Finally, and undoubtedly most importantly, this apparatus is far safer than the prior art. This is because the extractor (12) is attached to the heavy equipment (36) during all phases of the operation. Consequently there is no need to unload and assemble prior to extracting a pole (84), then, disassemble and reload in order to move to the next pole (84). As the bucket (34) is hydraulically or electrically actuated and can be articulated, positioning of the extractor (12) can be done with the aid of only one person on the ground.

At least one support member (40) is attached to a top surface (41) of the base (16) and has a holding means (42) located distal to the base (16), such that in use, the support member (40) is removably connected to the bucket (34) of the piece of heavy equipment (36) (see FIGS. 2 and 3). The support member (40) provides stabilization of the pole extractor (12), whether in use or in transit.

Also attached to the top surface (41) of the base (16) is a U-shaped rest (44), which locates and stabilizes the cylinder and ram assembly (14) during transit (FIG. 3). The rest (44) allows the cylinder and ram assembly (14) to be positioned and retained in a safe position during transport of the pole extractor (12).

Figure 4:
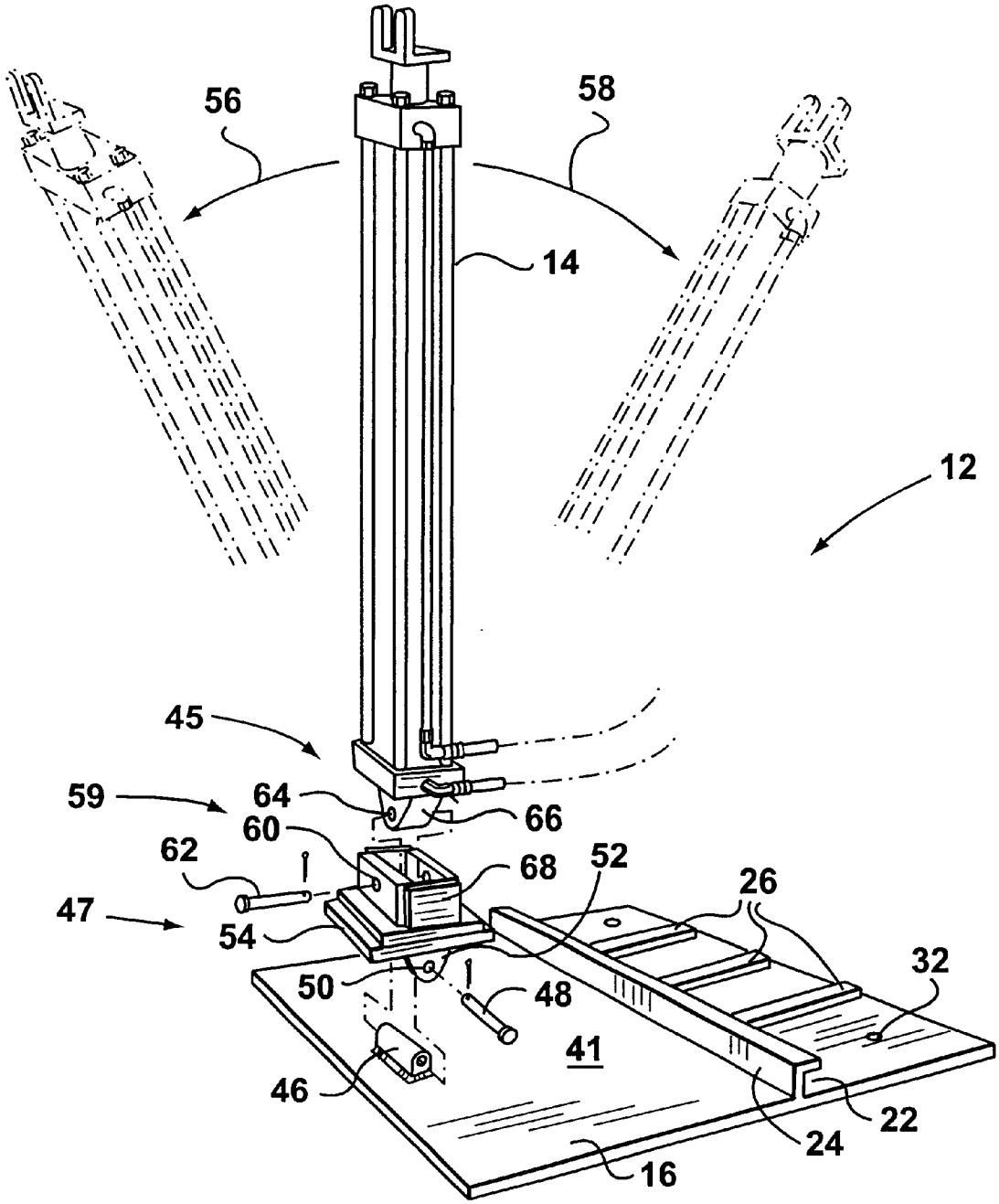
FIG. 4 is a perspective view of the pole extractor as shown in FIG. 1, showing an exploded view of rocker feet.
Figure 5:
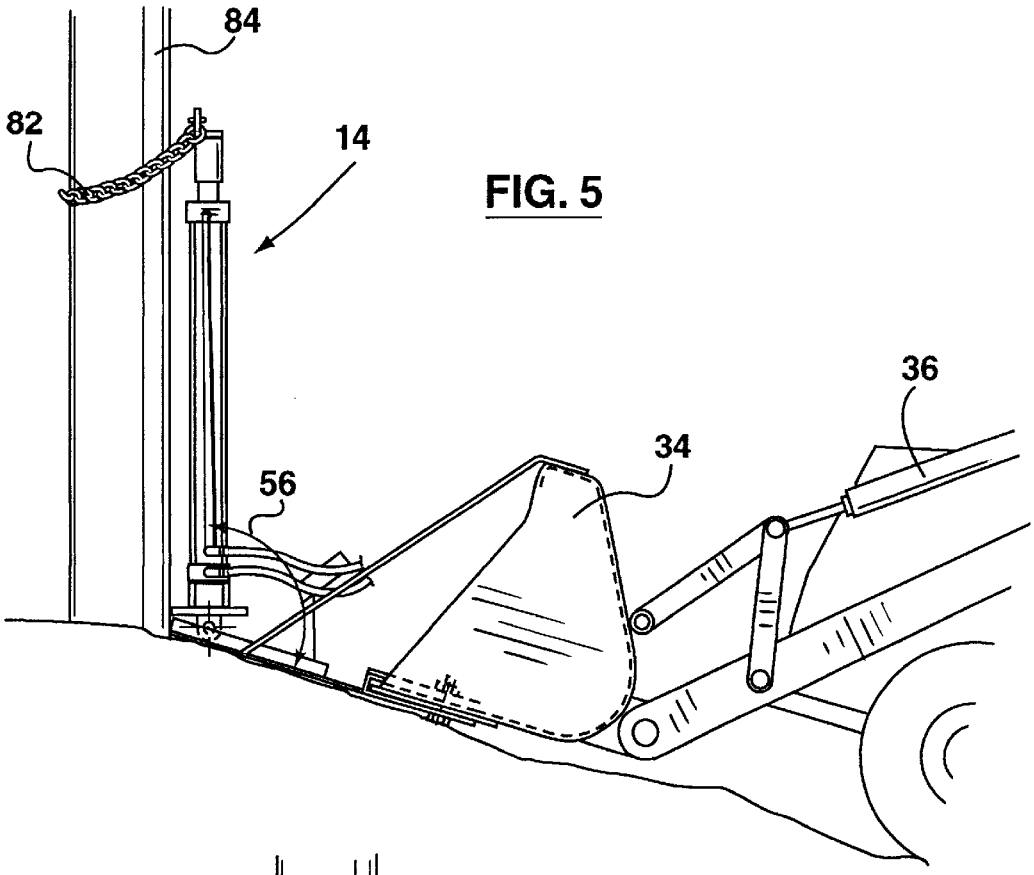
FIG. 5 is a side elevation view of the pole extractor as shown in FIG. 1 being used on an incline.
Figure 6:
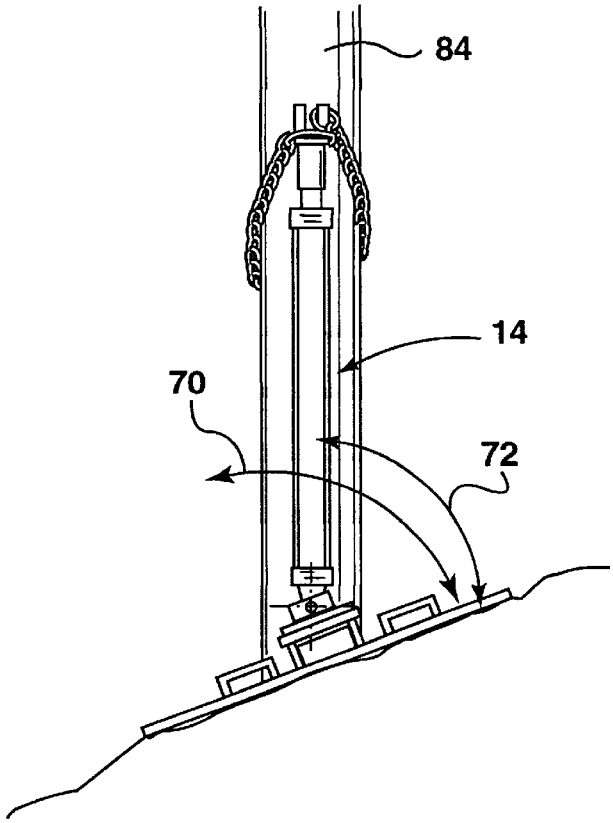
FIG. 6 is a front elevation view of the pole extractor as shown in FIG. 5.

As shown in FIG. 4, the cylinder and ram assembly (14) is moveably attached at a proximal end, generally indicated by number 45, to the top surface (41) of the base (16) at a sleeve (46) that accepts a proximal rocker foot, generally indicated by number 47. The proximal rocker foot (47) is comprised of a proximal rocker foot bolt (48), a proximal rocker foot hole (50), a proximal rocker (52) and a proximal rocker stop (54). In use, the cylinder and ram assembly (14) can swing between an obtuse (56) and an acute angle (58), relative to the attachment means (20), the proximal rocker stop (54) restricting further movement. A distal rocker foot, generally indicated by number 59, is located distally to the proximal rocker foot (47) and at right angles to it. The distal rocker foot (59) comprises a distal rocker foot bolt (62), a distal rocker foot hole (64), a distal rocker (66) and a pair of distal rocker stops (68) (FIG. 4). The distal rocker foot is accepted by a distal hole (60). As shown in FIG. 6, in use, the cylinder and ram assembly (14) can swing between an obtuse (70) and an acute angle (72), relative to said base (16), the distal rocker stop (68) restricting further movement. As shown in FIGS. 4, 5 and 6, the combination of the proximal rocker foot (47) and the distal rocker foot (59) provides two directions of rotation about the base (16), thereby approximating a universal type joint. This permits the extractor (12) to function equally as well on a hill, an incline or level ground. It also facilitates fine adjustment of the angle of the cylinder and ram assembly (14) relative to the pole (84) to be extracted.

Figure 7:
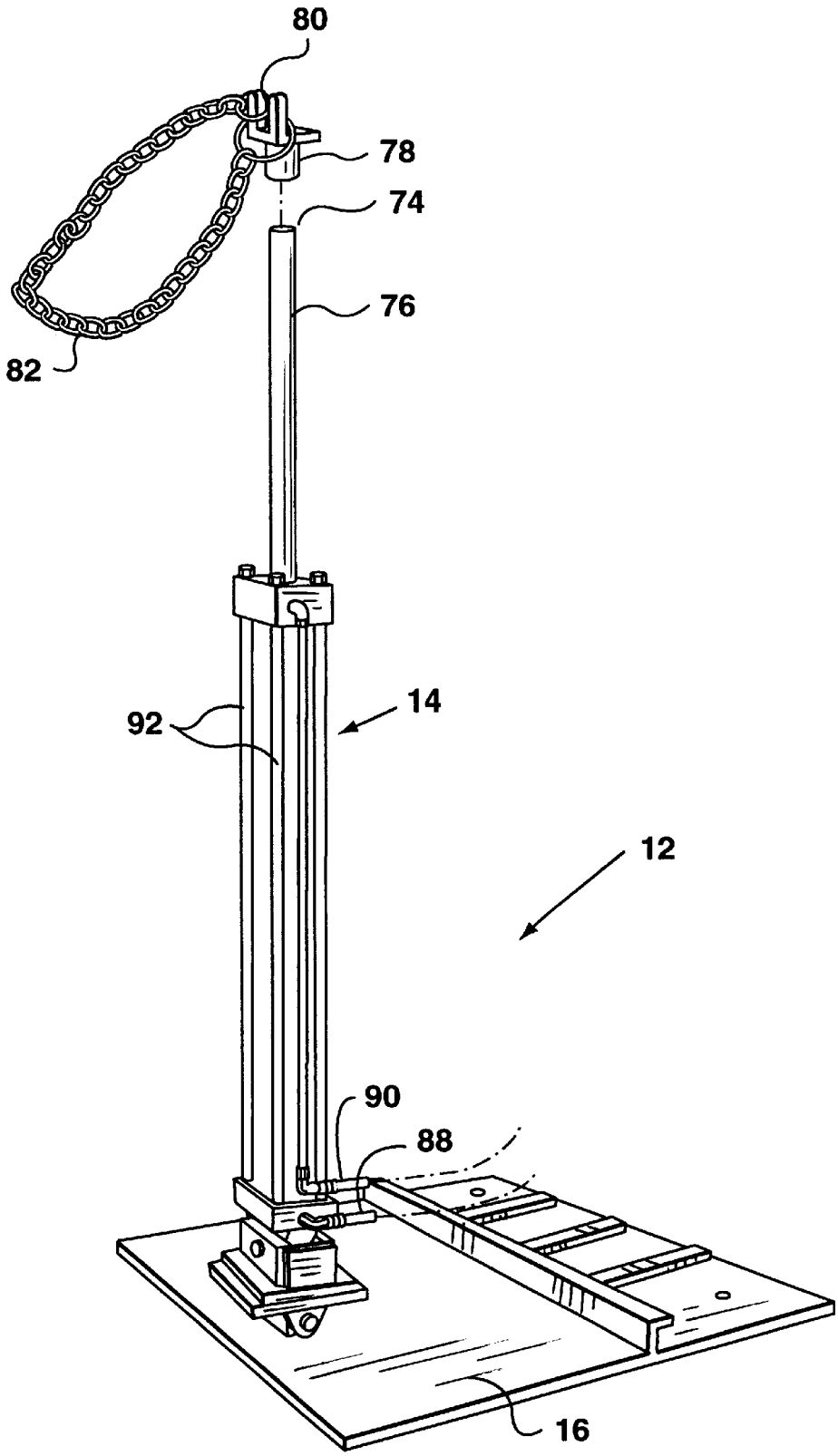
FIG. 7 is a perspective view of the pole extractor as shown in FIG. 1, showing an exploded view of a ram, holding means and connecting means.

As shown in FIG. 7, a distal end (74) of the ram (76) is fitted with a head (78) which is slidably, removably mounted on the ram (76). The head (78) can rotate freely with an axis parallel to the direction of movement of the ram (76). As a result, the pole extractor (12) can be positioned beside or in front of the pole (84). The head (78) is further described as having a connecting slot (80). In the preferred embodiment, a flexible holding means (82), for example, a chain or cable, is threaded through the connecting slot (80), such that in use, the holding means (82) chokes the pole (84) (see FIG. 1).

An actuating means (not shown), for example, a hydraulic system having a control module (not shown) and at least one hydraulic hose (86), is attached to the cylinder and ram assembly (14) by a fluid inlet (88) and a fluid outlet (90) (see FIGS. 1 and 7). Preferably, the control module (not shown) is remote, for example, in the piece of heavy equipment (36). This is preferred as it offers increased safety for an operator.

Figure 8:
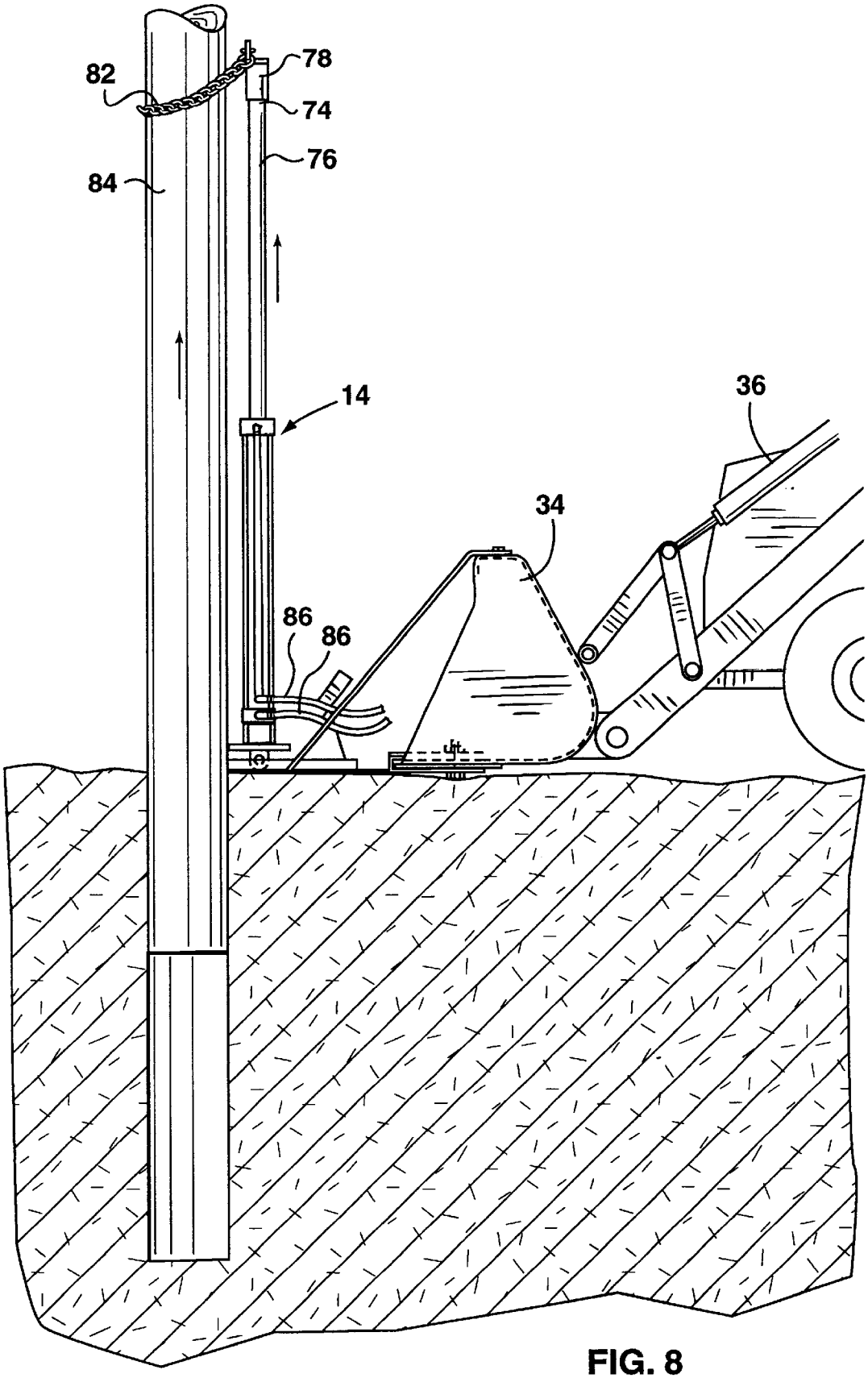
FIG. 8 is a side elevation view of the pole extractor as shown in FIG. 1, showing extension of the ram in the cylinder during extraction of the pole.
Figure 9:
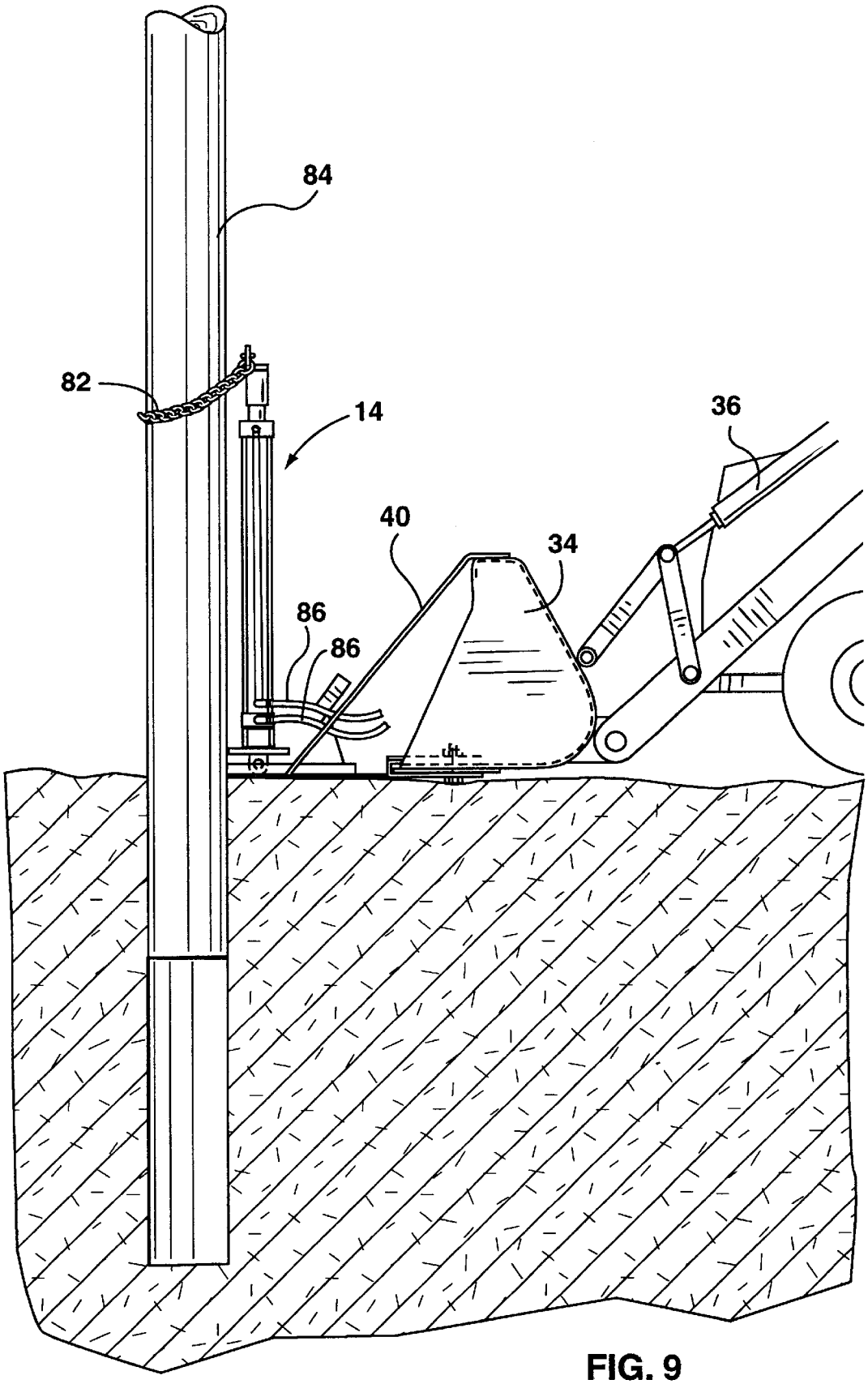
FIG. 9 is a side elevation view of the pole extractor as shown in FIG. 1, showing retraction of the ram in the cylinder during extraction of the pole.

In order to remove a pole (84), the pole extractor (12) is located beside or in front of the pole (84) with the aid of the heavy equipment (36). The cylinder and ram assembly (14) is then put into position manually. As shown in FIG. 7, a plurality of hand holds (92) are attached to the outer surface of the cylinder and ram assembly (14) to provide a means for workers to hold and pivot the assembly (14). Once in position, the pole (84) is choked with the chain (82) and the chain (82) is attached to the head (78) of the cylinder and ram assembly (14) by passing it through the connecting slot (80). Extraction of the pole (84) is by successive strokes of the ram (76), under the control of the actuating means (not shown). FIGS. 8 and 9 show extension and retraction of the ram (76) in the cylinder and ram assembly (14). A derrick (94) attached to a vehicle (not shown) then removes the extracted pole (84) from the work site. Once the pole (84) has been removed, the extractor (12) can be quickly detached from the pole (84) and moved to a new location.

If there is a need to remove the pole extractor (12) from the piece of heavy equipment, this can be done with a fork lift (not shown). As shown in FIG. 1, two channel members (96) mounted on the top surface (41) of the base (16) receive the forks of the fork lift.

The advantages of this invention will now be apparent to a person skilled in the art from the foregoing description of the preferred embodiment. Other embodiments and uses of this extractor in accordance with the invention will also now be readily apparent. For example, a cable could be employed rather than a chain to choke the pole.

What is claimed is:

1. A pole extractor having a base and a hydraulically operable cylinder and ram assembly, said base being coupled to an attachment means which extends over the base and is spaced from the base by a lip to define a slot for receiving a piece of heavy equipment between an upper surface of the slot and a lower surface of the slot, the attachment means defining the upper surface of the slot end the base defining the lower surface of the slot;

said cylinder and ram assembly having a proximal end coupling said assembly to the base, a ram having a distal end remote from the base, said distal end having connecting means to accept a holding means that in use, releasably holds a pole, whereby, upon extension of the ram within the cylinder and ram assembly, the pole is extracted.

2. A pole extractor as claimed in claim 1 having at least one support member extending from the base and having holding means distal to the base to removably couple the holding means to the piece of heavy equipment thereby further affixing and locating the extractor.

3. A pole extractor as claimed in claim 1, the connecting means including holding means to removably hold the pole.

4. A pole extractor as claimed in claim 3, said holding means being a chain.

5. A pole extractor as claimed in claim 1, the connecting means being removably disposed on the distal end of the ram.

6. A pole extractor as claimed in claim 1, the cylinder and ram assembly having a proximal rocker foot to pivotally couple the proximal end of the cylinder and ram assembly to the base and a distal rocker foot at right angles to said proximal rocker foot.

7. A pole extractor as claimed in claim 1 having a U-shaped rest mounted on the base to receive the cylinder and ram assembly thereby stabilizing said assembly during transit.

8. A pole extractor as claimed in claim 1 having at least two channels mounted on the base to receive fork lift forks for moving and positioning the pole extractor with a forklift.

9. A pole extractor having a base and a hydraulically operable cylinder and ram assembly, said base being coupled to an attachment means, said base having:

base holes to retain fastening means such that in use, the extractor is releasably fastened to a piece of heavy equipment;

a U-shaped rest mounted on the base to receive the cylinder and ram assembly for stabilizing said assembly during transit;

at least one support member to removably couple the base to the mobile positioning device, thereby further affixing and locating the extractor; and at least two channels mounted on the base to receive fork lift forks for moving and positioning the pole extractor with a forklift, said attachment means comprising a lip, a plurality of extension bars and fastening means, said extension bars being spaced from the base by a lip and extending at least partially over the base to define a slot for accepting the piece of heavy equipment, said cylinder and ram assembly having:

a proximal end coupling said assembly to the base;

a ram having a distal end remote from the base, said distal end having connecting means, said connecting means being removably disposed on the distal end of the ram and having holding means that in use, releasably holds a pole; and at least one rocker foot to pivotally couple a proximal end of the cylinder and ram assembly to the base;

wherein said cylinder and ram assembly is reciprocally fluid powered to control extension of the ram within the cylinder and ram assembly, whereby a pole is extracted.

10. A pole extractor having a base and a hydraulically operable cylinder and ram assembly, said base being coupled to an attachment means comprising at least one extension bar extending over the base and spaced from the base by a lip to define a slot for accepting a piece of heavy equipment, said cylinder and ram assembly having a proximal end coupling said assembly to the base, a ram having a distal end remote from the base, said distal end having connecting means to accept a holding means that in use, releasably holds a pole, whereby, upon extension of the ram within the cylinder and ram assembly, the pole is extracted.

11. A pole extractor as claimed in claim 10, said attachment means comprising said lip, a plurality of extension bars and fastening means, said extension bars being mounted on the lip and spaced along the length of the base, the extension bars extending at least partially over the base to define the slot, and the base having base holes to retain the fastening means such that in use, the extractor is releasably fastened to the piece of heavy equipment.

* * * * *